United States Patent [19]

de Nachtegaal

[11] 4,394,041

[45] Jul. 19, 1983

[54] HOISTING YOKE

[75] Inventor: Jakob de Nachtegaal, Hendrik Ido Ambacht, Netherlands

[73] Assignee: IHC Holland N.V., Papendrecht, Netherlands

[21] Appl. No.: 263,605

[22] Filed: May 14, 1981

[30] Foreign Application Priority Data

May 20, 1980 [NL] Netherlands ..... 8002900

[51] Int. Cl.[3] ..... B66C 1/10

[52] U.S. Cl. ..... 294/181 R; 294/67 R

[58] Field of Search ..... 294/67 R, 67 AA, 78 A, 294/81 R, 81 SF, 86 LS, 132

[56] References Cited

U.S. PATENT DOCUMENTS

| | | | |
|---|---|---|---|
| 3,404,911 | 10/1968 | Burnett | 294/81 SF |
| 3,413,028 | 11/1968 | Wilkie . | |
| 3,513,987 | 5/1970 | Seyff | 294/81 R X |
| 3,596,968 | 8/1971 | Holm . | |
| 3,675,960 | 7/1972 | Mangold . | |

FOREIGN PATENT DOCUMENTS

| | | | |
|---|---|---|---|
| 2053590 | 5/1972 | Fed. Rep. of Germany . | |
| 2443722 | 3/1976 | Fed. Rep. of Germany | 294/81 R |
| 1413559 | 8/1965 | France . | |
| 2191580 | 2/1974 | France . | |
| 7511230 | 9/1975 | Netherlands . | |
| 7608400 | 7/1976 | Netherlands . | |
| 309524 | 12/1929 | United Kingdom . | |
| 1186738 | 4/1970 | United Kingdom . | |
| 1360190 | 7/1974 | United Kingdom . | |
| 477929 | 7/1975 | U.S.S.R. | 294/81 R |
| 525609 | 11/1976 | U.S.S.R. | 294/81 R |

*Primary Examiner*—Johnny D. Cherry

*Attorney, Agent, or Firm*—Young & Thompson

[57] ABSTRACT

A hoisting yoke for a load. At its ends the beam or frame of the yoke has points of suspension for the load and a hoisting point. The hoisting point is displaceable for distributing the weight of the load uniformly over the points of suspension. The beam or frame of the yoke is provided with hoisting points at its opposite ends. The intermediate hoisting point is displaceable dependent on the load picked up by the hoisting points at the ends such that all of the hoisting points carry an equal part of the load.

2 Claims, 2 Drawing Figures

HOISTING YOKE

The invention relates to a hoisting yoke for lifting and displacing a load, said yoke consisting of a beam or frame having points of suspension for the load at opposite ends of the beam, respectively the frame, and having such a displacable hoisting point for a crane that the weight of the load can be uniformly distributed over the points of suspension. For example, such a hoisting yoke is known from the published Dutch Patent Application 6611354. In said known hoisting yoke two points of suspension are provided at or near the ends of the yoke and between said points of suspension is a hoisting point coupled with the hoisting yoke by means of hydraulic cylinders adapted to displace the hoisting point between the points of suspension in the one or the other direction, in order to obtain a uniform load on the points of suspension.

With heavy loads one hoisting point is not sufficient but several hoisting points should be used. Thus, from the published Dutch Patent Application 6805873 a hoisting yoke is known for displacing a container in which the frame forming the hoisting yoke has four hoisting points, i.e. two at each end. The coupling of said hoisting points to the crane takes place through cables running over pulleys at the hoisting points and subsequently through pulleys provided in the frame to hydraulic cylinders by which such a control of the length of the cable is possible that the load may be moved horizontally and the forces can be distributed uniformly.

With yet even heavier loads it is known to work with three hoisting points on each of which a separately working crane grips.

Then, it is particularly difficult to bring about a uniform distribution of the load, because one should first determine the location and the magnitude of the weight of the load and determine where and how one can lift the load and which forces must be exercised by the several cranes. This represents a time-consuming problem being not always solvable, at least not optimally solvable.

The invention has the object to provide a hoisting yoke which in using three hoisting points provides a uniform distribution of the forces exercised by the load in the hoisting cables quickly and if possible automatically.

According to the invention said object is achieved because the beam, respectively the frame, has hoisting points at opposite ends and the hoisting point lying between said hoisting points is displacable dependent upon the load picked up by the hoisting points at the end such that all of the hoisting points carry an equal part of a load.

According to the invention one uses a yoke having three hoisting points, the intermediate hoisting point of which is displacedly influenced by the load such that it moves to the most loaded hoisting point until all of the three hoisting points carry an equal part of the load. Said displacement can be effected by mechanical means or hydraulic cylinders responsive to the indication of means measuring the load at the hoisting points, in particular at the hoisting points at the ends, but naturally, it is also possible to provide this by means of measuring devices using the deviations of the horizontal position of the yoke for controlling the means determining the location of the intermediate hoisting point.

According to the invention, preferably the displacement of the intermediate hoisting point is dependent on the forces in the other hoisting points. This can be achieved for example by means of pressure cylinders between the hoisting points and the yoke delivering a signal to the displacement mechanism of the intermediate hoisting point until both of the pressure sensors sense the same value.

According to the invention, an extremely simple solution is obtained when the displacable hoisting point is coupled to the other hoisting points by two cables, each extending from the displacable hoisting point over a pulley of a carriage displacable along the beam, respective the frame, a pulley in the frame respectively on the beam and a tackle at the hoisting point. By locating the tackles at the hoisting points at the ends one obtains that in the cable portions extending to the displacable carriage from the intermediate hoisting point horizontal components of force are developed acting on the displacable carriage, said components being substantially equal to half of the load of one hoisting point. So long as said components are different from each other there is a resultant displacing the displacable carriage over the beam, respectively the frame, until both of the components in horizontal direction are equal to each other. When said condition is attained, then also in all of the three hoisting points the same load is developed.

Hereafter, the invention will be explained by reference to the drawing.

Figure 1:
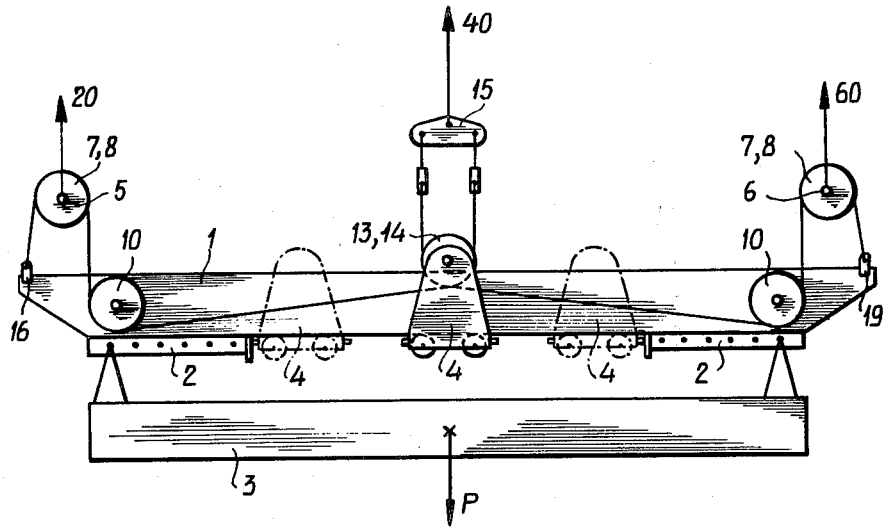
FIG. 1 shows schematically in side view the hoisting yoke according to the invention.
Figure 2:
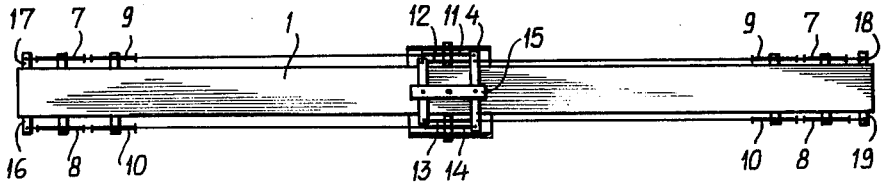
FIG. 2 is a top view.

The housing yoke shown in the drawing consists of a beam 1 at the underside of which strips 2 provided with apertures are fixed constituting the points of suspension for a load 3.

Movable in abutting relation to the underside of the beam 1 is a carriage 4.

At the ends of the beam tackles 5 and 6 are provided forming the hoisting points. Each tackle has a set of pulleys 7, 8.

Rotatably mounted around shafts fixed in the beam 1 are pulleys 9, 10 and in the carriage pulleys 11, 12, 13 and 14 are supported for rotation. The displacable hoisting point has a yoke 15.

Each cable extends from the yoke over a pulley 11, 12, 13 or 14, a pulley 9 or 10 and a pulley 7 or 8 of a tackle to a fixed fastening point 16, 17, 18 or 19.

Half of the load in each hoisting point 5 or 6 has through the cables a horizontal component of force acting on the carriage 4 at the pulleys 11–14.

If one assumes that in the hoisting point 5 a load of 20 tons occurs and in the hoisting point 6 a load of 60 tons, then, the two cables extending from the tackle 7, 8 to the carriage 4 have a horizontal component of force of the order of magnitude of 10 tons, whereas the cables extending from the right hand hoisting point 6 to the carriage act on the carriage with a horizontal component of force of the order of magnitude of 30 tons. Thereby, said carriage is is displaced to the right resulting in a decreasing load at the hoisting point 6 and an increasing load at the hoisting point 5. Said movement terminates when both of the horizontal components are equal to each other. The intermediate hoisting point carries half of the load of the two hoisting points at the ends and all of the three hoisting points carry the same load.

What is claimed is:

1. A hoisting yoke for lifting and displacing a load, comprising an elongated frame, means at opposite ends of the frame for supporting the frame, suspension means intermediate the length of the frame displaceable lengthwise of the frame for sharing the load of the frame, and means responsive to unequal loading of said supporting means at the ends of the frame to move said intermediate means lengthwise of the frame until the loading at the opposite ends of the frame and at the intermediate means are all three equal.

2. A hoisting yoke as claimed in claim 1, in which said intermediate means is coupled to said supporting means at the ends of the frame by means of two cables each extending from the ends of the frame over a pulley at each end of the frame and about a tackle on the intermediate means.

* * * * *